US010780962B2

(12) United States Patent
Cappelletti et al.

(10) Patent No.: US 10,780,962 B2
(45) Date of Patent: Sep. 22, 2020

(54) VENTILATION SYSTEM

(71) Applicants: Sergio Cappelletti, Leghorn (IT); Sergio Carlini, Ancona (IT)

(72) Inventors: Sergio Cappelletti, Leghorn (IT); Sergio Carlini, Ancona (IT)

( * ) Notice: Subject to any disclaimer, the term of this patent is extended or adjusted under 35 U.S.C. 154(b) by 0 days.

(21) Appl. No.: 16/348,788

(22) PCT Filed: Nov. 10, 2016

(86) PCT No.: PCT/IB2016/056773
§ 371 (c)(1),
(2) Date: May 9, 2019

(87) PCT Pub. No.: WO2018/087580
PCT Pub. Date: May 17, 2018

(65) Prior Publication Data
US 2019/0291834 A1 Sep. 26, 2019

(51) Int. Cl.
*B63G 8/36* (2006.01)
*B63G 8/40* (2006.01)

(52) U.S. Cl.
CPC ..... *B63G 8/36* (2013.01); *B63G 8/40* (2013.01)

(58) Field of Classification Search
CPC ..... B63G 8/40
See application file for complete search history.

(56) References Cited

U.S. PATENT DOCUMENTS 9,031,733 B1 * 5/2015 Licis ..... G06F 19/00 701/29.2
2012/0318188 A1 * 12/2012 Hudson ..... B63G 8/22 114/333
2015/0380748 A1 * 12/2015 Marich ..... H01M 8/04716 429/423
2016/0096603 A1 * 4/2016 Bertin ..... B63G 8/36 114/337

FOREIGN PATENT DOCUMENTS

| | | |
|---|---|---|
| EP | 2301839 | 3/2011 |
| FR | 384644 | 4/1908 |
| FR | 427253 | 7/1911 |
| GB | 2300835 | 11/1996 |

OTHER PUBLICATIONS

International Search Report and Written Opinion, PCT/IB2016/056773, dated Jun. 30, 2017, pp. 1-12.
Office Action issued in corresponding European Application No. 16816385.5 dated Mar. 6, 2020.

* cited by examiner

*Primary Examiner* — Benjamin F Fiorello
(74) *Attorney, Agent, or Firm* — The Belles Group, P.C.

(57) ABSTRACT

System for emergency ventilation of an underwater environment (dry); the system includes a supply device to supply air; a capsule to be immersed in water to a depth of at least 60 meters; a duct to fluidically connect the power device to the capsule; a duct in order to fluidically connect the capsule to the underwater environment; a duct to fluidically connect the underwater environment to the capsule; a compressor to discharge the gas, arriving in the capsule from the underwater environment, in water at a depth of at least 60 meters.

14 Claims, 2 Drawing Sheets

VENTILATION SYSTEM

CROSS-REFERENCE TO RELATED PATENT APPLICATIONS

The present application is a U.S. national stage application under 35 U.S.C. § 371 of PCT Application No. KT/IB2016/056773, filed Nov. 10, 2016. The disclosure of the aforementioned priority application is incorporated herein by reference in its entirety.

TECHNICAL FIELD

The present invention relates to a system for emergency ventilation of an underwater environment, a method for the emergency ventilation of an underwater environment and a capsule for the emergency ventilation of an underwater environment.

This invention also relates to the use of the system and/or the capsule for an emergency recovery intervention of underwater environment.

Context of the Invention

In the deep diving systems sector, when it is necessary to recover a damaged underwater environment (for example a submarine and/or a welding habitat), a rescue vessel (or a platform) is usually used equipped with a large compressed air storage system. The underwater environment is connected to two ducts, one is for transferring the pressurized air from this storage system to the underwater environment, and the other to bring the exhaust air back to the surface. The air that is pushed must be with high pressure, since it has to reach the underwater environment and come back to surface (to facilitate this air movement, there are some pumps at the end of the second duct).

The recovery activities as described above, have certain disadvantages including: the necessity to have huge and expensive devices to direct the pressurized air and (most of all) to recovery and allow air to escape in surface; and a relevant pressure increase inside the underwater environment with some health risks for the operators inside the underwater environment and the necessity to keep them in a decompression chamber in way to reduce embolism risks, once they are recovered.

The aim of the present invention is to provide an emergency ventilation system of an underwater environment, a method for the emergency ventilation of an underwater environment and a capsule for the emergency ventilation of an underwater environment and a use of the system and/or of the capsule for an emergency recovery, which make it possible to overcome, at least partially, the inconvenience of this type of activity and is at the same time cost-effective and easy to realize.

SUMMARY

According to the present invention, an emergency ventilation system for an underwater environment, a method for the emergency ventilation of an underwater environment, a capsule for the emergency ventilation of an underwater environment and a use of the system and/or the capsule for an emergency recovery is provided, as recited in the independent claims below, and, preferably, in any one of the claims depending directly or indirectly on the aforementioned independent claims.

BRIEF DESCRIPTION OF THE PICTURES

Figure 1:
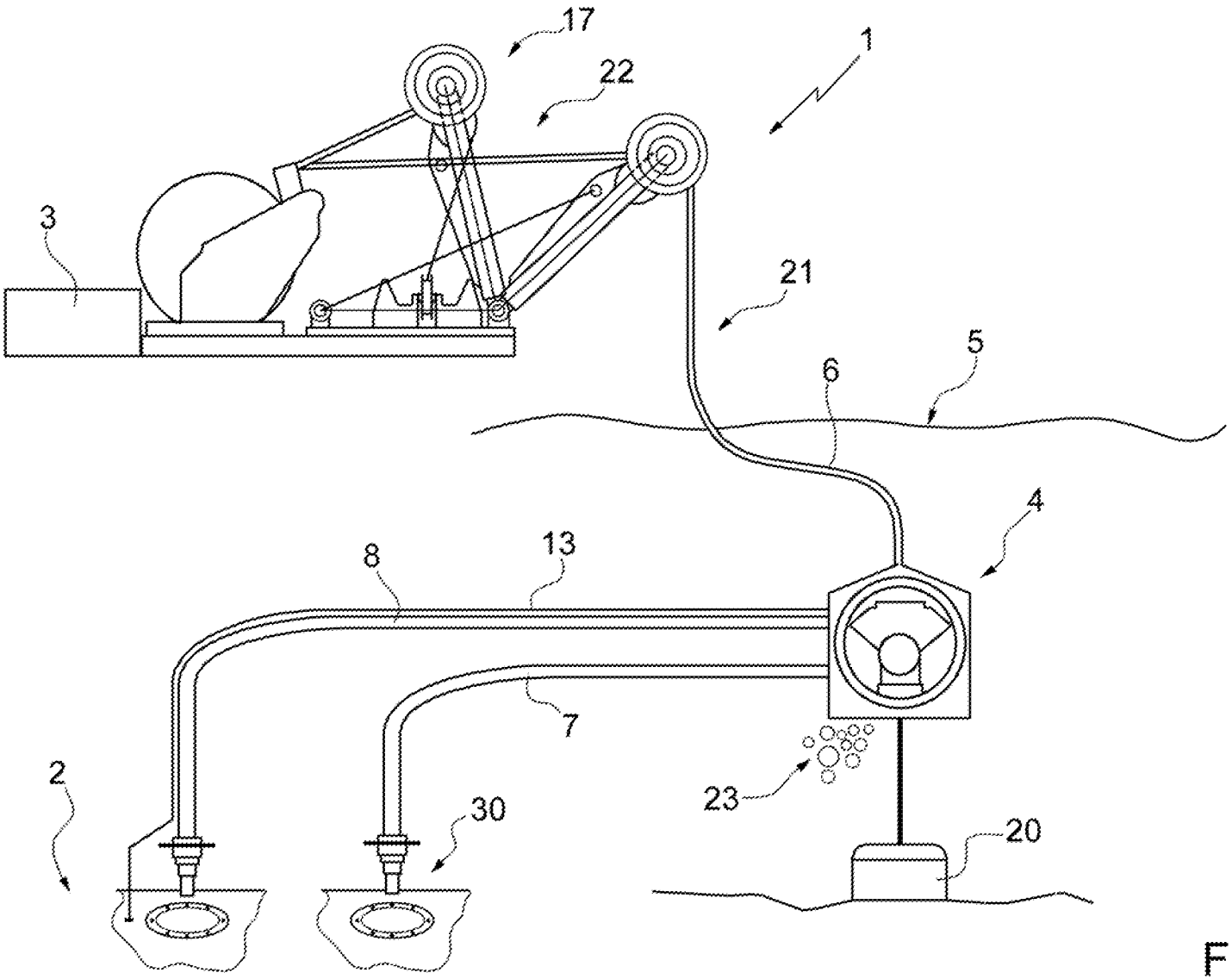
Figure 2:
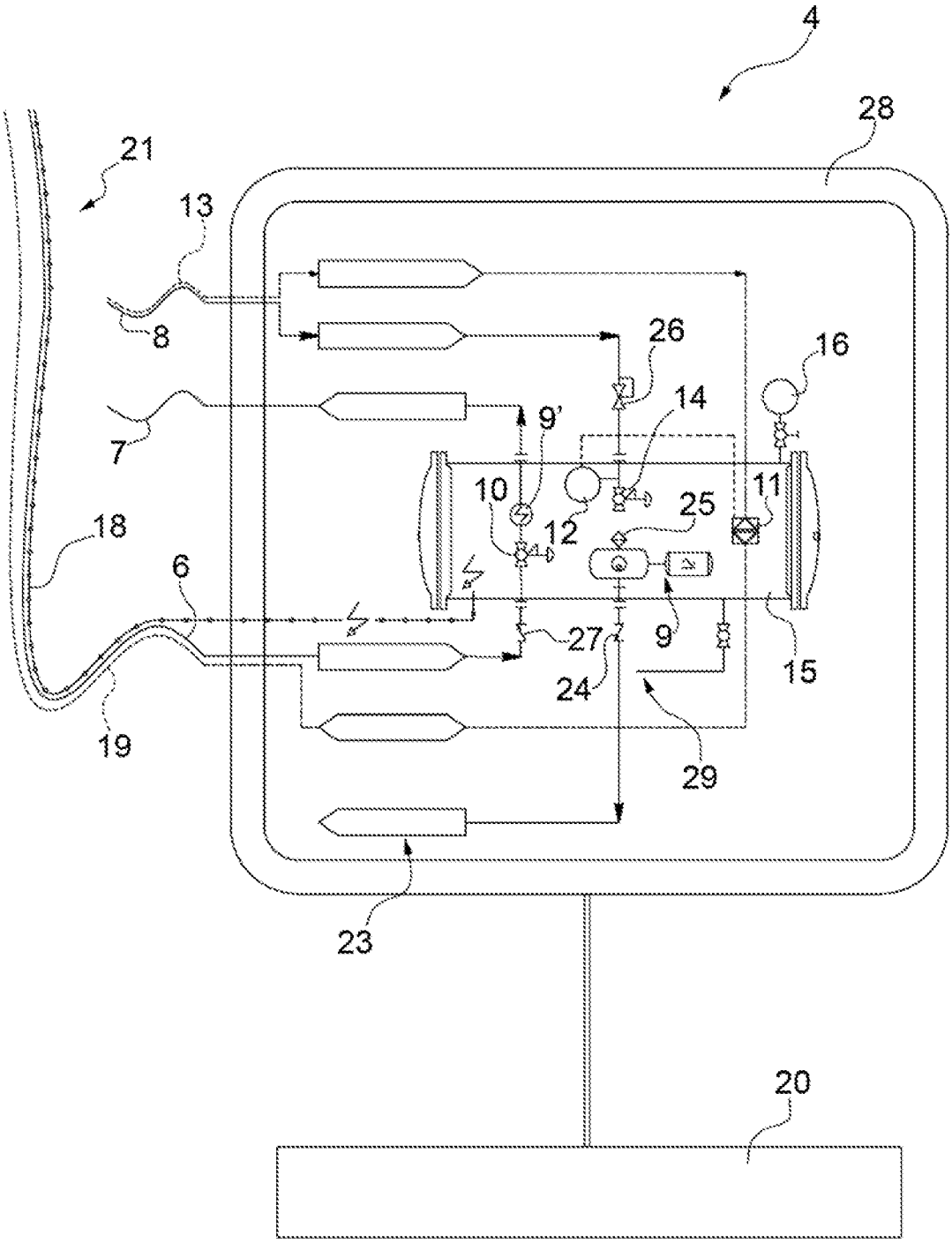

The invention is hereinafter described with reference to the accompanying drawings, which describe a non-limiting embodiment, wherein:

FIG. 1 is a lateral and schematic view of a system according to this invention; and FIG. 2 is a lateral and schematic view, where some internal details of a part of the system shown in FIG. 1 are depicted.

DETAILED DESCRIPTION

In FIG. 1, 1 indicates a system for the emergency ventilation of an underwater environment 2 (dry) as a whole. According to some non-limiting examples, the underwater environment 2 is a submarine and/or a welding habitat.

The system 1 comprises a supply device 3 for providing a gas containing oxygen, in particular air; a capsule 4 adapted to be immersed in water (in particular, to a depth of at least 60 meters—below the surface 5); a duct 6 to fluidically connect the power supply device 3 to the capsule 4 so that the capsule 4 uploads the gas coming from the supply device 3.

Advantageously but not necessarily, the capsule 4 is adapted to be immersed in water to a depth of at least 100 meters (below the surface 5 of water).

The system 1 comprises also a duct 7 to fluidically connect the capsule 4 to the underwater environment 2 so as to allow the passage of gas from the capsule 4 to the underwater environment 2 itself; a duct 8 to fluidically connect the underwater environment 2 to the capsule 4 so that it allows the passage of the gas from the underwater environment 2 to the capsule 4; and one compressor 9 for the exhaust of the gas arrived inside the capsule 4 through the duct 8 from the underwater environment 2 into the water at a depth of at least 60 meters (under the surface 5 of the water itself). In particular, the compressor 9 is adapted to unload the gas inside water at a depth of at least 100 meters (under the surface 5 of the water itself). The compressor 9 is fluidically connected to duct 8.

In particular, the capsule 4 includes the compressor 9.

More precisely, the duct 6 is extended from the supplying device 3 to the capsule 4; the duct 7 and 8 protrude from capsule 4 and are arranged to bond at the underwater environment 2.

Advantageously but not necessarily, the supplying device 3 is suitable to be (and during the use is) placed outside of the water in an environment substantially dry.

According to some not limiting embodiments, the supplying device 3 is designed to supply gas to the capsule 4 at a pressure that is higher than atmospheric pressure (for example, at a pressure up to 3 bar).

Advantageously but not necessarily, the system 1 (more precisely, the capsule 4) comprises an adjustment device 10 to adjust the pressure of the gas that is supplied to the underwater environment 2. More particularly, the adjustment device 10 is designed to adjust the pressure of the gas inside the duct 7, so that the gas reaches the underwater environment 2 at a pressure that is lower than a first given pressure (in some cases of 3 bar absolute—corresponding to $30^5$ Pa). More precisely, the adjustment device 10 is suitable to adjust the pressure of the gas inside the duct 7, so that the gas reaches the underwater environment 2 at a pressure that is lower than a first given pressure of 2 bar—corresponding to 205 Pa.

In particular, higher-pressure levels, up to 6 bar, may be necessary to maintain the ventilation flow whenever pressure increases take place due to failures inside the underwater environment 2.

According to some embodiments, the adjustment device 10 comprises (is) a valve (in some cases a ball valve) and/or a membrane mechanism. Due to the adjustment device 10 the risk of excessive pressure increase inside the underwater environment 2 is reduced. Advantageously but not necessarily, the system 1 (more precisely, the capsule 4) comprises a control unit 11.

In some cases, the control unit 11 is designed to adjust the operation of at least one between the supplying device 3 and compressor 9 (and/or the heat exchanger 9'), so as to keep the concentration of the carbon dioxide (and/or other specific gases) and/or oxygen (and/or the temperature) (and/or the ventilation) inside the underwater environment 2 within a given interval (to allow the air inside the underwater environment 2 to be breathable for the operators located inside it).

For example, where an oxygen concentration which may be considered too low is detected, the control unit 11 will operate the supplying device 3 and the compressor 9 in such a way to increase the air flow (coming from the surface) through the capsule 4.

In some cases, the system 1 comprises a sensor 12 for the detection of the carbon dioxide and/or oxygen concentration inside the gas coming from the underwater environment 2 (particularly, through the duct 8).

In addition, or alternatively, the system 1 comprises a connection 13 for a detection system, which is arranged in the underwater environment 2 and is designed to detect the concentration of carbon dioxide (and/or of other specific gases) and/or oxygen (and/or temperature) in the underwater environment 2 itself. In particular, the control unit 11 is connected to the sensor 12 and/or to the connection 13 and is adapted to adjust the actuation of at least one of the power supply device 3 and the compressor 9 (and/or the heat exchanger 9') according to what is detected by the sensor 12 and/or by the detection system (of the underwater environment 2), respectively.

Advantageously but not necessarily, the system 1 (in particular, the capsule 4) includes a heat exchanger 9 in order to heat the gases to be fed in the underwater environment 2 through the duct 7. In particular, the heat exchanger 9' is connected to the compressor 9 so that the heat produced by the compressor 9 itself can be used.

According to some non-limiting embodiments, the system 1 (in particular, the capsule 4) comprises an adjusting device 14 to allow the passage of gas from the underwater environment 2 to the compressor 9 through the duct 8 when the pressure in the duct 8 is higher than a reference pressure (in particular, 1 bar absolute, more particularly, not more than 1 bar in addition to the original pressure of the underwater environment 2). More precisely, the adjusting device 14 comprises (is) a valve (in some cases a ball valve) and/or a diaphragm mechanism. Thanks to the adjusting device 14 it reduces the risk that the pressure inside the underwater environment 2 decreases excessively.

According to some non-limiting embodiments, the system 1 (in particular, the capsule 4) comprises a tank 15 for fluidically connecting the duct 8 and the compressor 9. In particular, the duct 8 goes from the reservoir 15 to the underwater environment 2.

More precisely, the tank 15 fluidically connects (is located between) the adjusting device 14 and the compressor 9.

Advantageously but not necessarily, the control unit 11 is adapted to activate the compressor 9 so as to maintain the pressure inside the tank 15 in a given range, in particular compatible with the performance of the compressor 9 (more specifically, from 1 bar to 2 bar absolute). In particular, the capsule 4 comprises a pressure sensor 16 for measuring the pressure inside the tank 15. More particularly, the control unit 11 activates the compressor 9 as a function what is detected by the pressure sensor 16.

In some cases (such as the one illustrated in FIG. 2), a valve (ball valve) is located between the sensor 16 and the tank 15.

Typically but not necessarily, the system 1 includes a vessel or a platform 17, on which the power supply device 3 is located. In particular, the power supply device 3 comprises a pump (and a tank/gas storage) which enables the gas (air) to be pushed from above the water surface 5 to the capsule 4.

According to some non-limiting embodiments, the system 1 also includes an electrical connection 18 for supplying electrical energy to the capsule 4 (and its components) from outside (in particular, from the platform 17). More precisely, the electrical connection 18 is adapted to supply the control unit 11, the compressor 9 and the sensors 12 and 16.

Advantageously but not necessarily, the system 1 also comprises a link 19 to allow the transfer of information between the boat or platform 17 and the control unit 11.

According to some non-limiting embodiments, the system 1 comprises a ballast 20, which, in particular, maintains the capsule 4 at the required depth (maintaining its own stability in water).

Advantageously but not necessarily, system 1 includes an auxiliary umbilical cable 21, which is adapted to bear the weight of the capsule 4 (and possibly also the ballast 20) in the air and the related dynamic loads during the launching. In particular, the electrical connection 18, the link 19 and in the duct 6 are part of or connected to (inserted into) the umbilical cable 21. More particularly, the umbilical cable 21 connects the vessel or platform 17 to the capsule 4.

According to some non-limiting embodiments, the system 1 also includes a launch and recovery unit 22, which is suitable for moving (for example, bring it in water and/or lift it) the capsule 4 by acting on the umbilical cable 21.

According to some non-limiting embodiments, the capsule 4 includes an exhaust outlet 23, adapted to allow the exit of the gas (exhausted) in the water from the capsule 4. The compressor 9 is designed to convey the gas through the exhaust outlet 23.

Advantageously but not necessarily, a one-way valve 24 (to prevent water coming from the exhaust outlet 23 reaches the compressor 9) is located between the exhaust outlet 23 and the compressor 9. According to some non-limiting embodiments, the capsule 4 comprises a filter 25 also, which is located between the duct 8 (more specifically, the adjusting device 10; even more precisely, the tank 15) and the compressor 9. The filter 25 helps to improve the mechanical protection of the compressor 9.

According to some non-limiting embodiments, the capsule 4 also comprises a vacuum breaker valve 26, which is located downstream of the underwater environment 2 in order to avoid creating an excessive depression in the underwater environment 2 itself. In particular, the vacuum breaker valve 26 is located between the duct 8 and the compressor 9.

Advantageously but not necessarily, a one-way valve 27 which allows the passage of gas only from the duct 6 to the capsule 4 and not vice versa is also provided. More precisely, the one-way valve 27 is placed between the duct 6 and the adjusting device 10.

In particular, the capsule 4 comprises a casing 28 (typically of metal), which is resistant to the external pressure at high depth and encloses the various further components of the capsule 4, for example: the adjustment devices 10 and 14, the unit control 11, the sensors 12 and 16 and the tank 15 (and, possibly, the one-way valves 24 and 27, the vacuum breaker valve 26 and the filter 25).

According to some embodiments not illustrated and not limitative, the capsule 4 can be composed of two or more separate groups each one provided with its own casing 28.

In some cases, in order to improve maintenance activities, a vent 29 is also provided to allow the correct emptying of the tank 15. In particular, a valve (ball valve) is located between the tank 15 and the vent 29.

In operation, after the launch from the surface, the capsule 4 reaches the depth required (in particular, a depth similar to the underwater environment depth 2 where it operates).

At this point, the capsule 4 (more precisely, the ducts 7 and 8—and potentially the connection 13) is connected to the underwater environment 2, for example by means of a ROV, through an underwater environment 2 emergency connection 30.

At this point, the power supply device 3 and the compressor 9 are actuated to allow the supply of gas (fresh air) from above the surface 5 to the capsule 4 and from the capsule 4 to the underwater environment 2, and the gas (exhaust air) from the underwater environment 2 to the compressor 9 and from the compressor 9 to the water (through the exhaust outlet 23).

Please note that the system 1 in accordance with the present invention has considerable advantages over known systems. Among these, we emphasize that the system 1 according to the present invention is relatively simple and cost-effective (especially because it does not require any equipment to transfer and vent the exhaust air to the surface) and less harmful and dangerous for the health of the operators present in the underwater environment 2 (you can keep relatively low pressures within the underwater environment 2).

In particular, in accordance with an additional aspect of this invention, a method for the emergency ventilation of an underwater environment 2 (dry) is provided with a system as described above, and comprising: a first supplying step, during which the gas is fed from the supply device 3 to the capsule 4 immersed in water at a pressure higher than the atmospheric pressure; a second supplying step, during which the gas is conveyed from the capsule 4 immersed in water to the underwater environment 2 through the duct 7; a recovery step, which is at least partly subsequent to the second supplying step and during which the gas is brought from the underwater environment 2 to the capsule 4 immersed in the water through the duct 8; and a draining step, which is at least partially after the recovery step and during which the gas coming from the underwater environment 2 and arriving to the capsule 4, which is immersed in the water, is discharged into the water.

Advantageously but not necessarily, during the first and the second supplying steps, the recovery step and the draining step, the capsule 4 is maintained immersed in water at a distance of at most 40 meters from the underwater environment 2.

Typically, the underwater environment 2 is at a depth of 60 (in particular, from 100) to 700 meters (from the surface 5).

According to some non-limiting embodiments, during the supply step, the gas pressure coming from the supply device 3 is maintained within a given range in the area of the capsule 4, in particular proportional to the depth of intervention (more particularly between 2 bar absolute and a higher value due to the increase in pressure that makes it possible to overcome the pressure losses of the flow line, according to the depth of intervention—70 bar absolute for example).

According to some non-limiting embodiments, the method also comprises a pressure regulation step, during which, in the area of the capsule 4, the gas pressure (from the capsule 4 itself) towards the underwater environment 2 is maintained (flow rate) within a given range.

In particular, during the regulation step, the gas pressure (coming from the supplying device 3) is reduced.

According to some non-limiting embodiments (in other words), during the second supply step, the gas is conveyed from the capsule 4, which is immersed in water, to the underwater environment 2 at a pressure within the given range.

In particular, the pressure of the gas conveyed from the capsule 4 to the underwater environment 2 during the second supply step is less than the pressure of the gas supplied to the capsule 4 during the first supply step.

In particular, the given range is from 1 bar absolute to 3 bar absolute (more particularly, to 2 bar).

In particular, in accordance with further aspect of this invention, a capsule 4 as described above is provided.

In accordance with a further aspect of this invention, a use of the system 1 and/or of the capsule 4 for a emergency recovery intervention of an underwater environment 2 is provided (such an underwater environment 2 is as described above). In particular, the use provides to follow a method as described above.

The invention claimed is:

1. A system for the emergency ventilation of a (dry) underwater environment, the system comprising:

- a supplying device to supply a gas containing oxygen, in particular air;
- a capsule, which is designed to be immersed in water up to a depth of at least 60 meters;
- a first duct to fluidically connect the supplying device to the capsule, so that the gas coming from the supplying device can get to the capsule;
- a second duct to fluidically connect the capsule to the underwater environment, so as to allow the gas to flow from the capsule to the underwater environment;
- a third duct to fluidically connect the underwater environment to the capsule, so as to allow the gas to flow from the underwater environment to the capsule; and
- a compressor to drain the gas, which arrives at the capsule through the third duct from the underwater environment, into the water at a depth of at least 60 meters; the compressor being fluidically connected to the third duct.

2. A system according to claim 1, wherein the supplying device is designed to supply the gas to the capsule at a pressure that is higher than atmospheric pressure.

3. A system according to claim 1 and comprising a first adjustment device to adjust the pressure of the gas that is supplied to the underwater environment, in particular through the second duct, so that the gas reaches the underwater environment at a pressure that is lower than a first given pressure.

4. A system according to claim 3, wherein the first given pressure is 2 bar (205 Pa).

5. A system according to claim 1 and comprising a control unit, which is designed to adjust the operation of at least one between the supplying device and the compressor, so as to keep the concentration of carbon dioxide and/or oxygen inside the underwater environment within a given interval.

6. A system according to claim 1 and comprising at least one between a sensor for detecting the concentration of carbon dioxide and/or oxygen in the gas coming from the underwater environment (in particular, through the third duct) and a connection for a detection system, which is arranged in the underwater environment and is designed to detect the concentration of carbon dioxide and/or oxygen in the gas coming from the underwater environment (in particular, through the third duct).

7. A system according to claim 1, wherein the capsule includes a heat exchanger to heat the gas to be supplied to the underwater environment through the second duct; in particular, the heat exchanger connected to the compressor so as to use the heat produced by the compressor itself.

8. A system according to claim 1 and comprising a second adjustment device to allow gas to flow from the underwater environment to the compressor through the third duct, when the pressure in the third duct exceeds a reference pressure.

9. A system according to claim 1 and comprising a tank to fluidically connect the third duct and the compressor; in particular, the third duct extends from the tank to the underwater environment.

10. A system according to claim 9 and comprising a control unit operate the compressor so as to keep the pressure inside the tank within a given interval.

11. A system according to claim 1, wherein the first duct extends from the supplying device to the capsule; the second duct starts from the capsule and is designed to get to the underwater environment.

12. A method for the emergency ventilation of a (dry) underwater environment with a ventilation system according to claim 1 and comprising:

a first supplying step, during which the gas is supplied from the supplying device to the capsule immersed in water at a pressure that is higher than atmospheric pressure;

a second supplying step, during which the gas is conveyed from the capsule immersed in water to the underwater environment through the second duct;

a recovery step, which at least partially takes place after the second supply step and during which gas is taken from the underwater environment to the capsule immersed in water through the third duct; and a draining step, which at least partially takes place after the recovery step and during which the gas that comes from the underwater environment and has reached the capsule immersed in water is drained into the water.

13. A method according to claim 12, wherein, during the first and the second supplying step, the recovery step and the draining step, the capsule is kept immersed in water at a distance of 40 meters at most from the underwater environment.

14. A method according to claim 12 comprising a pressure adjusting step, during which, in the area of the capsule, the pressure of the gas directed the underwater environment is kept within a given interval.

* * * * *